US010132313B2

(12) United States Patent
Tanaka

(10) Patent No.: US 10,132,313 B2
(45) Date of Patent: Nov. 20, 2018

(54) UNIAXIAL ECCENTRIC SCREW PUMP

(71) Applicant: HEISHIN Ltd., Hyogo (JP)

(72) Inventor: Kei Tanaka, Kobe (JP)

(73) Assignee: HEISHIN LTD., Hyogo (JP)

( * ) Notice: Subject to any disclaimer, the term of this patent is extended or adjusted under 35 U.S.C. 154(b) by 0 days.

(21) Appl. No.: 15/563,575

(22) PCT Filed: Oct. 19, 2016

(86) PCT No.: PCT/JP2016/080916
§ 371 (c)(1),
(2) Date: Sep. 30, 2017

(87) PCT Pub. No.: WO2017/110221
PCT Pub. Date: Jun. 29, 2017

(65) Prior Publication Data

US 2018/0087507 A1 Mar. 29, 2018

(30) Foreign Application Priority Data

Dec. 25, 2015 (JP) ..... 2015-255002

(51) Int. Cl.
*F01C 5/04* (2006.01)
*F04C 5/00* (2006.01)
(Continued)

(52) U.S. Cl.
CPC ..... *F04C 15/0042* (2013.01); *F04C 29/0021* (2013.01); *F04C 2/107* (2013.01);
(Continued)

(58) Field of Classification Search
USPC ..... 418/48, 152, 201.2, 153
See application file for complete search history.

(56) References Cited

U.S. PATENT DOCUMENTS 2,874,643 A * 2/1959 Bourke ..... F04C 2/1073 418/108
3,028,812 A 4/1962 Scotti
(Continued)

FOREIGN PATENT DOCUMENTS

DE 2331173 A1 1/1975
DE 3619787 A1 * 12/1987 ..... F04C 2/1075
(Continued)

OTHER PUBLICATIONS

English translation of DE 3619787 by Espacenet Jul. 2018.*
(Continued)

*Primary Examiner* — Mark Laurenzi
*Assistant Examiner* — Deming Wan
(74) *Attorney, Agent, or Firm* — Renner, Otto, Boisselle & Sklar, LLP

(57) ABSTRACT

A uniaxial eccentric screw pump includes: a stator 32 having a female threaded inner peripheral surface; a rotor 33 configured to be insertable into the stator 32, and formed of a male threaded shaft body; an exterior body 31 configured to be movable between a first position where the exterior body 31 is capable of compressing the stator 32 and a second position where the exterior body 31 at least alleviates a compression state of the stator 32; and guide members 55, 56 configured to restrict a movement of the exterior body 31 in a circumferential direction of the stator while allowing a movement of the exterior body 31 in a radial direction of the stator by guiding an end portion of the exterior body 31.

6 Claims, 14 Drawing Sheets

(51) Int. Cl.

| | |
|---|---|
| ***F03C 2/22*** | (2006.01) |
| ***F01C 21/10*** | (2006.01) |
| ***F04C 15/00*** | (2006.01) |
| ***F04C 29/00*** | (2006.01) |
| *F04C 2/107* | (2006.01) |
| *F04C 18/107* | (2006.01) |

(52) U.S. Cl.
CPC ..... *F04C 18/107* (2013.01); *F04C 2240/10* (2013.01); *F04C 2240/20* (2013.01); *F04C 2240/30* (2013.01); *F04C 2240/80* (2013.01)

(56) References Cited

U.S. PATENT DOCUMENTS 3,229,643 A * 1/1966 Roudaut ..... F04B 43/021 417/475
3,857,654 A * 12/1974 Streicher ..... F04C 2/1075 418/108

FOREIGN PATENT DOCUMENTS

| | | | | | |
|---|---|---|---|---|---|
| DE | 4116697 | C1 | | 3/1992 | |
| EP | 1326023 | A2 | | 7/2003 | |
| EP | 2660471 | A1 | | 11/2013 | |
| JP | 50-22310 | A | | 3/1975 | |
| JP | 60-173381 | A | | 9/1985 | |
| JP | 60173381 | A | * | 9/1985 | ..... F04C 2/1075 |
| JP | 2010-1876 | A | | 1/2010 | |
| KR | 2013-0131421 | A | | 12/2013 | |

OTHER PUBLICATIONS

English translation of JP 60173381 from East, Jul. 2018.*
Written Opinion, and English translation, for corresponding International Patent Application No. PCT/JP2016/080916, dated Jan. 24, 2017. (Only Japanese language version previously submitted.).
International Search Report for corresponding International Application No. PCT/JP2016/080916, dated Jan. 24, 2017.
Written Opinion (PCT/ISA/237) for corresponding International Application No. PCT/JP2016/080916, dated Jan. 24, 2017.

* cited by examiner

UNIAXIAL ECCENTRIC SCREW PUMP

This is a national phase application in the United States of International Patent Application No. PCT/JP2016/080916 with an international filling date of Oct. 19, 2016, which claims priority from Japanese Patent Application No. 2015-255002 filed on Dec. 25, 2015, the disclosures of which are incorporated herein by reference in their entireties.

TECHNICAL FIELD

The present invention relates to a uniaxial eccentric screw pump.

BACKGROUND ART

In general, in a uniaxial eccentric screw pump, a stator expands and contracts in response to a change of a liquid temperature or an atmospheric temperature. Accordingly, there may be a case where it is difficult to convey a fluid material in an appropriate state which corresponds to such a change. For example, in CIP (Cleaning In Place) or SIP (Sterilizing In Place), vapor or hot water of a high temperature is made to flow in the pump and hence, the above-mentioned problem arises. That is, in CIP or SIP, after a fluid material (foods, chemicals or the like) of a room temperature is conveyed, vapor or hot water of a high temperature is made to flow in the pump for cleaning or sterilizing the inside of the pump. At this stage of operation, when an interference between a rotor and a stator is set to a value which conforms to a fluid material of a room temperature, the stator expands so that an interference becomes excessively large whereby a frictional force between the rotor and the stator becomes large. As a result, a torque required for rotating the rotor is increased or the stator wears or is damaged earlier than an expected life time. On the other hand, when an interference between the rotor and the stator is made small in advance by taking into account the expansion of the stator brought about by vapor or hot water of a high temperature which is made to flow in CIP or SIP, a fluid material of a room temperature cannot be properly conveyed.

Conventionally, as a uniaxial eccentric screw pump capable of solving such a problem, there has been known a uniaxial eccentric screw pump having the following configuration. In such a state where a stator made of an elastic material is housed in the inside of a casing and a rotor is inserted into the stator, an air pressure in a space formed between the casing and the stator is adjusted so as to elastically deform the stator toward the inside thus maintaining a contact pressure of the stator to the rotor at a fixed value (see JP 60-173381 A, for example).

However, it is difficult to properly control a pressure in the space for maintaining a contact pressure of the stator to the rotor at a fixed value. When the pressure is large, for example, a cavity which is a space for conveying a fluid material formed between the rotor and the stator becomes small so that the pump cannot acquire a desired discharge amount. Further, a frictional force between the rotor and the stator becomes large so that a torque required for rotating the rotor is increased or the stator wears earlier than an expected life time. On the other hand, when the pressure is small, even when the rotor is rotated, a sufficiently smooth flow of a fluid material cannot be ensured whereby it is impossible to discharge the fluid material at a desired discharge pressure.

Further, an air pressure directly acts on the stator and hence, when damage such as a crack occurs in the stator, there may be a case where air leaks through a damaged portion. In this case, it is difficult to press the stator to the rotor at a desired fastening pressure. There may be also a case where air is mixed into a fluid material through the damaged portion or a fluid material flows out through the damaged portion. Mixing of air into a fluid material (particularly food) gives rise to a problem in terms of quality. On the other hand, when a fluid material flows out to the surrounding, a flowout portion of the surrounding is contaminated.

PRIOR ART DOCUMENT

Patent Document

Patent Document 1: JP 60-173381 A

SUMMARY OF THE INVENTION

Problems to be Solved by the Invention

It is an object of the present invention to provide a uniaxial eccentric screw pump which can make a contact pressure of a stator to a rotor stable so that a fluid material can be discharged at a desired discharge pressure and damage on the stator minimally occurs.

Means for Solving the Problems

As a means for solving the above-mentioned problem, the present invention provides a uniaxial eccentric screw pump which includes:

a stator having a female threaded inner peripheral surface;

a rotor configured to be insertable into the stator, and formed of a male threaded shaft body;

an exterior body configured to be movable between a first position where the exterior body is capable of compressing the stator and a second position where the exterior body at least alleviates a compression state of the stator; and a guide member configured to restrict a movement of the exterior body in a circumferential direction of the stator while allowing a movement of the exterior body in a radial direction of the stator by guiding an end portion of the exterior body.

With such a configuration, by merely moving the position of the exterior body between the first position and the second position, an interference can be set to an appropriate value such that a fastening force of the stator to the rotor becomes stable. That is, it is possible to set an appropriate fastening margin which corresponds to a degree of expansion of the stator based on a difference in temperature of a fluid material or an atmospheric temperature and hence, it is possible to prevent wear of the stator, the increase of a rotational torque of the rotor or a change in discharge pressure of a fluid material.

Further, a movement of the exterior body in the circumferential direction of the stator is prevented by the guide member and hence, there is no possibility that the exterior body is rotated along with the rotation of the rotor. Accordingly, although the rotation of the stator was prevented only at an end portion of the stator conventionally, the rotation of the stator can be prevented also by the guide member and hence, the stator is minimally damaged by repeated fatigue.

The end portion of the exterior body may have an engaging portion on an end surface thereof, and the guide member may have a portion to be engaged which positions the engaging portion in the circumferential direction while allowing a movement of the engaging portion in the radial direction of the stator.

The uniaxial eccentric screw pump may further include a mounting portion on which the guide member is mounted, and the guide member may be formed in an annular shape, and may be mounted on the mounting portion.

The guide member is preferably formed of a plurality of guide portions which are formed by dividing the guide member in the circumferential direction, and the plurality of guide portions are preferably mounted on the mounting portion in an annularly continuous state.

With such a configuration, by making use of the mounting portion, the guide member formed of the plurality of guide portions can be easily mounted in an annularly continuous state. Further, compared to the case where the guide member is formed of a single member, the mounting operation can be performed easily.

It is preferable that the guide member and the mounting portion form a slide structure which is configured to move the respective guide portions to an inner diameter side so as to bring inner surfaces of the respective guide portions into close contact with an outer surface of the stator in connecting the mounting portion and the guide member to each other.

With such a configuration, by merely connecting the mounting portion and the guide member to each other, the respective guide portions can be moved toward the inner diameter side by the slide structure and hence, the guide member can be supported in a stable manner and sealability at the end portion of the stator can be enhanced.

A reinforcing body is preferably integrally provided to the exterior body.

With such a configuration, for example, the exterior body can acquire sufficient rigidity even when the exterior body is made of a synthetic resin material. As a result, the deformation of the exterior body can be effectively prevented.

The uniaxial eccentric screw pump preferably further includes a drainage structure for draining vapor or water from a space in which the stator and the exterior body are disposed.

With such a configuration, even when vapor permeates the stator and reaches the outside of the stator, vapor can be discharged with certainty by the drainage structure and hence, the stagnation of vapor or water in the space can be prevented.

Effect of the Invention

According to the present invention, a movement of the exterior body in the radial direction of the stator is allowed and hence, an interference between the rotor and the stator can be freely changed whereby a fastening force can be set to an appropriate value. Further, a movement of the exterior body in the circumferential direction of the stator is restricted and hence, a torque load generated along with the rotation of the rotor can be dispersed whereby a torque load which acts on the end portion of the stator is alleviated thus preventing the occurrence of damage on the end portion of the stator.

BRIEF DESCRIPTION OF THE DRAWINGS

The foregoing and the other feature of the present invention will become apparent from the following description and drawings of an illustrative embodiment of the invention in which.

MODE FOR CARRYING OUT THE INVENTION

Hereinafter, embodiments according to the present invention are described with reference to attached drawings. The description made hereinafter essentially only exemplifies the embodiment of the present invention, and the description is not intended to limit the present invention, a product to which the present invention is applied, or the application of the present invention. Further, drawings are schematically shown, and the size ratios of respective parts and the like differ from those of actual parts.

Figure 1:
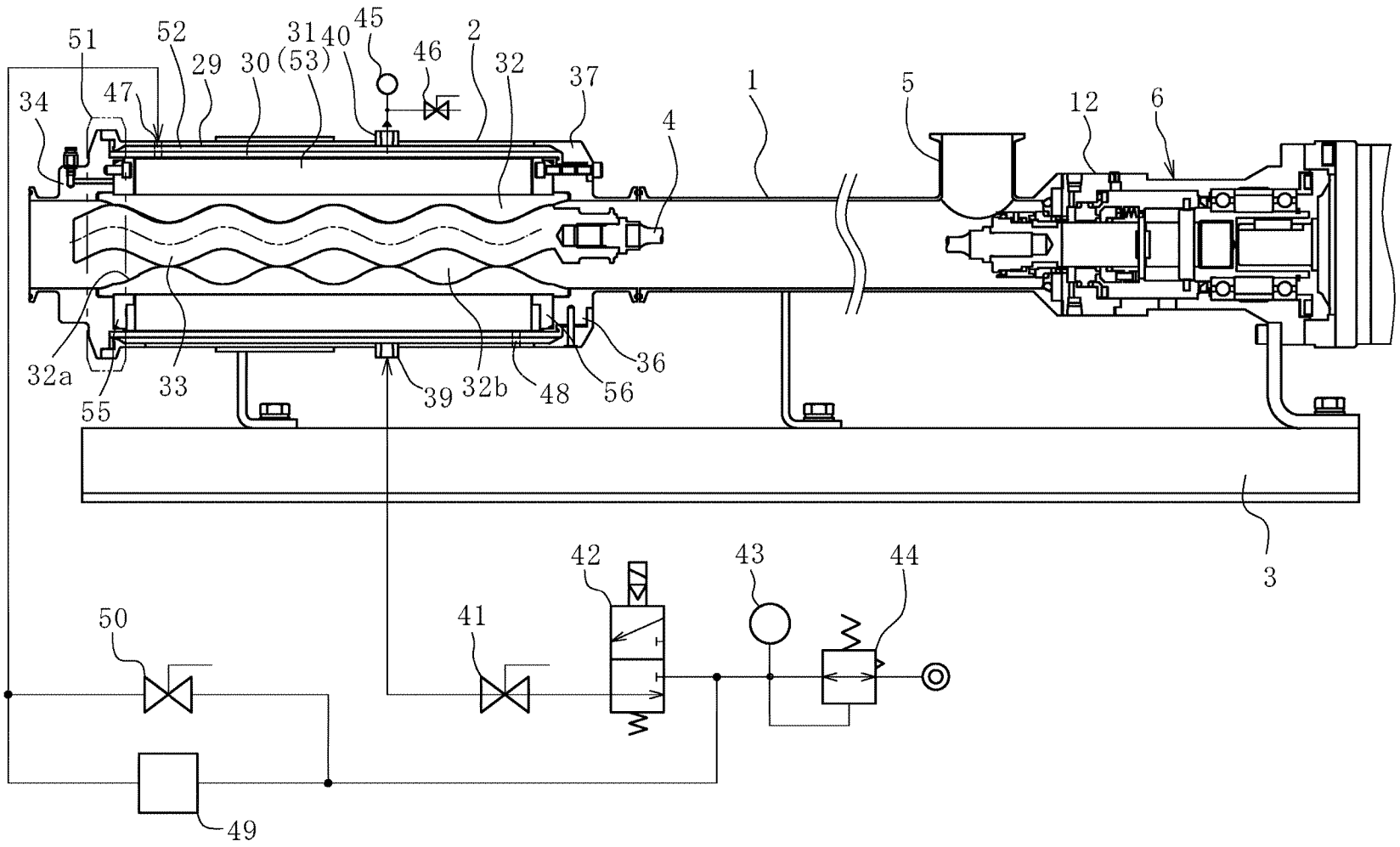
FIG. 1 is a schematic cross-sectional view of a uniaxial eccentric screw pump according to an embodiment.

FIG. 1 shows a uniaxial eccentric screw pump according to this embodiment. The uniaxial eccentric screw pump includes: a drive unit (not shown in the drawing) disposed on one end side of a first casing 1; and a pump body 2 disposed on the other end side of the first casing 1. The uniaxial eccentric screw pump is supported on a stand 3.

The first casing 1 is a cylindrical body made of a metal material, and a coupling rod 4 is disposed in the inside of the first casing 1. A connecting pipe 5 is connected to an outer peripheral surface of the first casing 1 on one end side, and a fluid material can be supplied to the first casing 1 from a tank or the like not shown in the drawing. One end portion of the coupling rod 4 is connected to a drive transmission portion 6 on a drive unit side.

Figure 2:
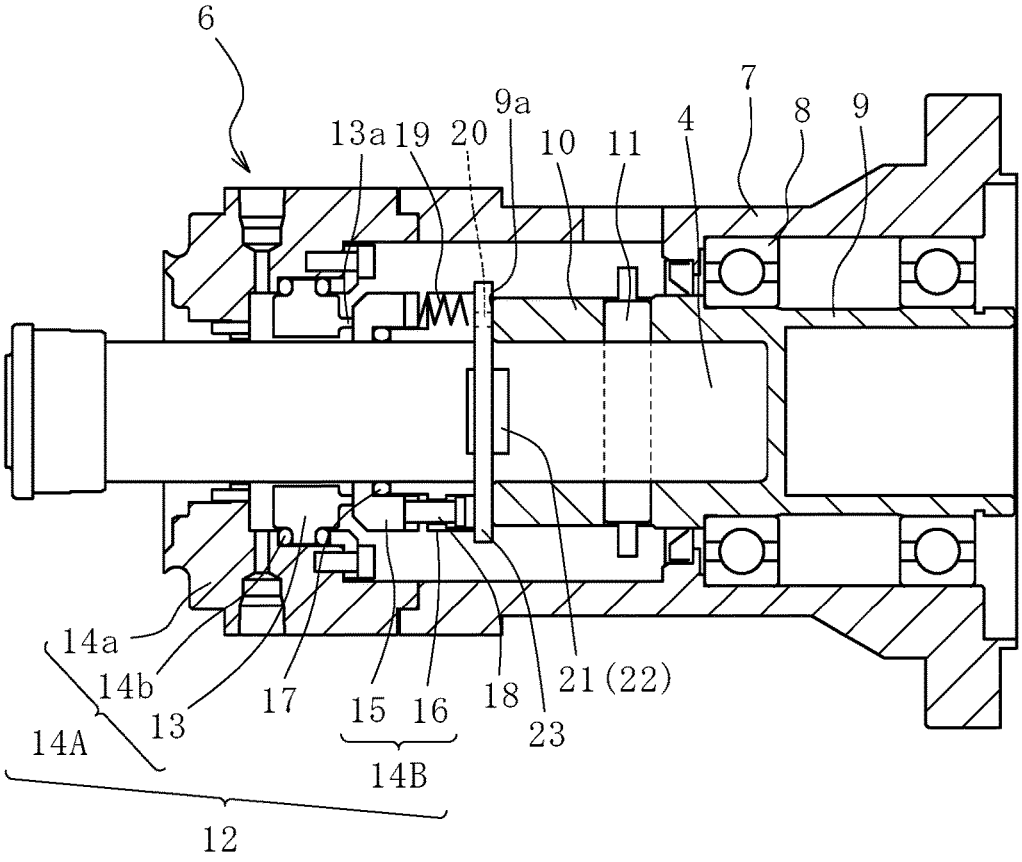
FIG. 2 is a partially enlarged view showing a drive transmission portion in FIG. 1.
Figure 3B:
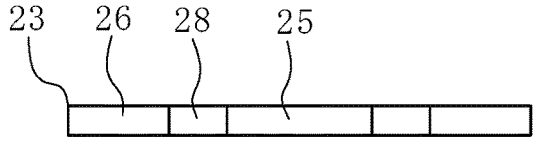
FIG. 3B is a plan view of the set plate.
Figure 3A:
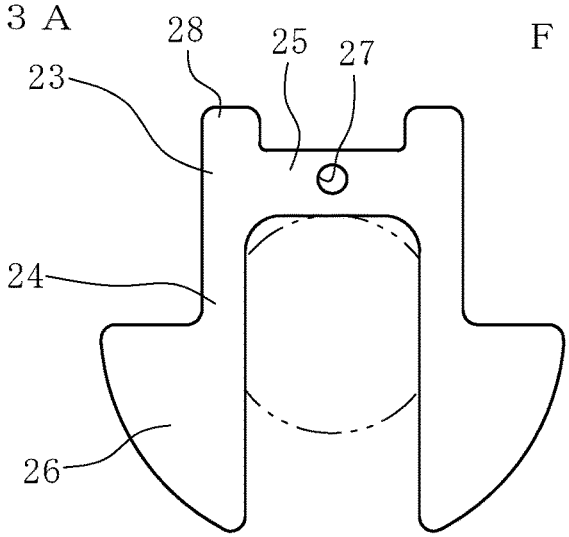
FIG. 3A is a front view (a back view being equal to the front view) of a set plate.
Figure 3C:
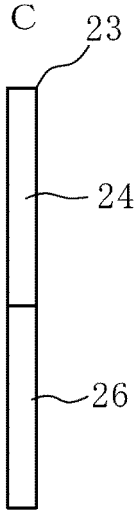
FIG. 3C is a right side view (a left side view being equal to the right side view) of the set plate.
Figure 3D:
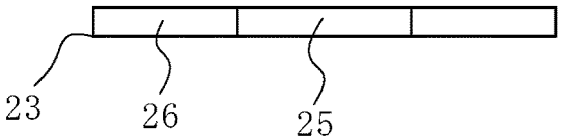
FIG. 3D is a bottom view of the set plate.
Figure 3E:
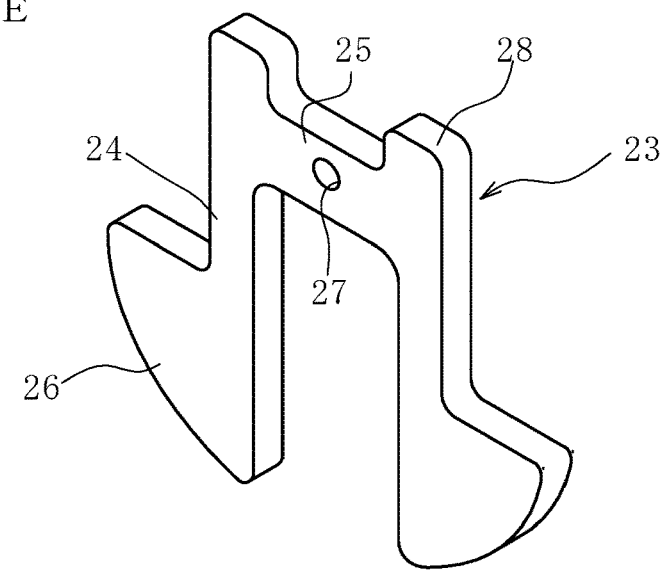
FIG. 3E is a perspective view of the set plate.

As shown in FIG. 2, the drive transmission portion 6 includes a drive shaft 9 which is rotatably supported by bearings 8 in a second casing 7. The drive shaft 9 is rotated by driving the drive unit. A cylindrical portion 10 is formed on a distal end of the drive shaft 9, and one end portion of the coupling rod 4 is inserted into the cylindrical portion 10. The coupling rod 4 and the drive shaft 9 are connected to each other by fitting a connecting pin 11 into the coupling rod 4 and the drive shaft 9. With such a configuration, power of the drive unit is transmitted to the coupling rod 4.

A mechanical seal 12 is mounted on an outer periphery of one end portion of the coupling rod 4. The mechanical seal 12 includes a fixed ring 14A and a rotary ring 14B.

The fixed ring 14A is formed by disposing a seat ring 13 in the inside of a sealing cover 14*a* with an O ring 14*b* interposed therebetween. An annular projecting portion 13*a* is formed on an end surface of the seat ring 13.

The rotary ring 14B is formed of a driven ring 15 and an annular portion 16. The driven ring 15 has an inner peripheral surface having a stepped shape, and a small-diameter inner peripheral surface of the driven ring 15 is brought into contact with an outer peripheral surface of the coupling rod 4. An O ring 17 is mounted on a large-diameter inner peripheral surface of the driven ring 15 such that the O ring 17 is brought into contact with a stepped portion formed between the large-diameter inner peripheral surface and the small-diameter inner peripheral surface of the driven ring 15. The annular portion 16 is mounted on the coupling rod 4 such that the annular portion 16 is movable in an axial direction by a guide pin 18 in a reciprocating manner with respect to the driven ring 15. The annular portion 16 is biased in a direction away from the driven ring 15 by a spring 19. A positioning pin 20 is integrally formed on an end surface of the annular portion 16.

A pair of groove portions 22 (mounting grooves) is formed on the outer peripheral surface of the coupling rod 4. The groove portions 22 have flat surfaces 21 (bottom surfaces) which are formed orthogonal to a radial direction and an axial direction of the coupling rod 4 and parallel to each other. The set plate 23 is mounted on the coupling rod 4 by making use of these groove portions 22 so that the removal of the rotary ring 14B in the axial direction is prevented and the rotary ring 14B can be temporarily fixed to the coupling rod 4.

The set plate 23 is a plate-like body formed by applying press working to a metal material such as stainless steel. As shown in FIG. 3, the set plate 23 is formed of: a pair of leg portions 24 and a connecting portion 25 which connects these leg portions 24 with each other.

The leg portions 24 are formed such that a distance between inner surfaces of the leg portions 24 which oppositely face each other is equal to a size in a width direction between the flat surfaces 21 formed on the coupling rod 4 (with a clearance which allows the arrangement of the leg portions 24 on the flat surfaces 21). An expanded portion 26 having a sector shape is formed on lower end portions of the respective leg portions 24. The expanded portions 26 are formed for making the position of the center of gravity of the set plate 23 agree with an axis of the coupling rod 4 when the set plate 23 is mounted on the coupling rod 4. With such a configuration, even when the coupling rod 4 is rotated so that a centrifugal force acts on the set plate 23, the movement of the set plate 23 toward an outer diameter side can be suppressed. Outer peripheral edges of the expanded portions 26 are positioned on the same circumference about the position of the center of gravity of the set plate 23. Accordingly, an expansion region of the set plate 23 around a surrounding area can be minimized.

A pin hole 27 is formed in a center portion of the connecting portion 25. The positioning pin 20 formed on the annular portion 16 of the rotary ring 14B is inserted into the pin hole 27 so that the position of the rotary ring 14B in the radial direction is restricted with respect to the set plate 23 mounted on the coupling rod 4. An operation lug 28 projects from both ends of an upper portion of the connecting portion 25. As described later, the operation lugs 28 are used at the time of mounting the set plate 23 on the coupling rod 4 or at the time of removing the set plate 23 from the coupling rod 4.

In a state where the rotary ring 14B is temporarily fixed to the coupling rod 4 by the set plate 23, the drive shaft 9 on a drive unit side is connected to the coupling rod 4. In connecting the drive shaft 9 to the coupling rod 4, the set plate 23 is pushed in an axial direction by a distal end opening edge portion 9*a* of the drive shaft 9 so that the set plate 23 is positioned at a proper position. Accordingly, power from the drive unit can be transmitted to the coupling rod 4. In such a state, the leg portions 24 of the set plate 23 are engaged with the groove portions 22 formed on the coupling rod 4 so that a rotational force of the coupling rod 4 is transmitted to the set plate 23. The positioning pin 20 of the rotary ring 14B is engaged with the pin hole 27 formed in the set plate 23 so that a rotational force of the set plate 23 is transmitted to the rotary ring 14B. That is, the set plate 23 plays a role of positioning the rotary ring 14B in the axial direction of the coupling rod 4, a role of transmitting a rotational force to the rotary ring 14B from the coupling rod 4, and a role as a jig used in mounting the rotary ring 14B.

Returning to FIG. 1, the pump body 2 is a member where a sleeve 30, an exterior body 31, a stator 32, and a rotor 33 are housed in a third casing 29.

Figure 4:
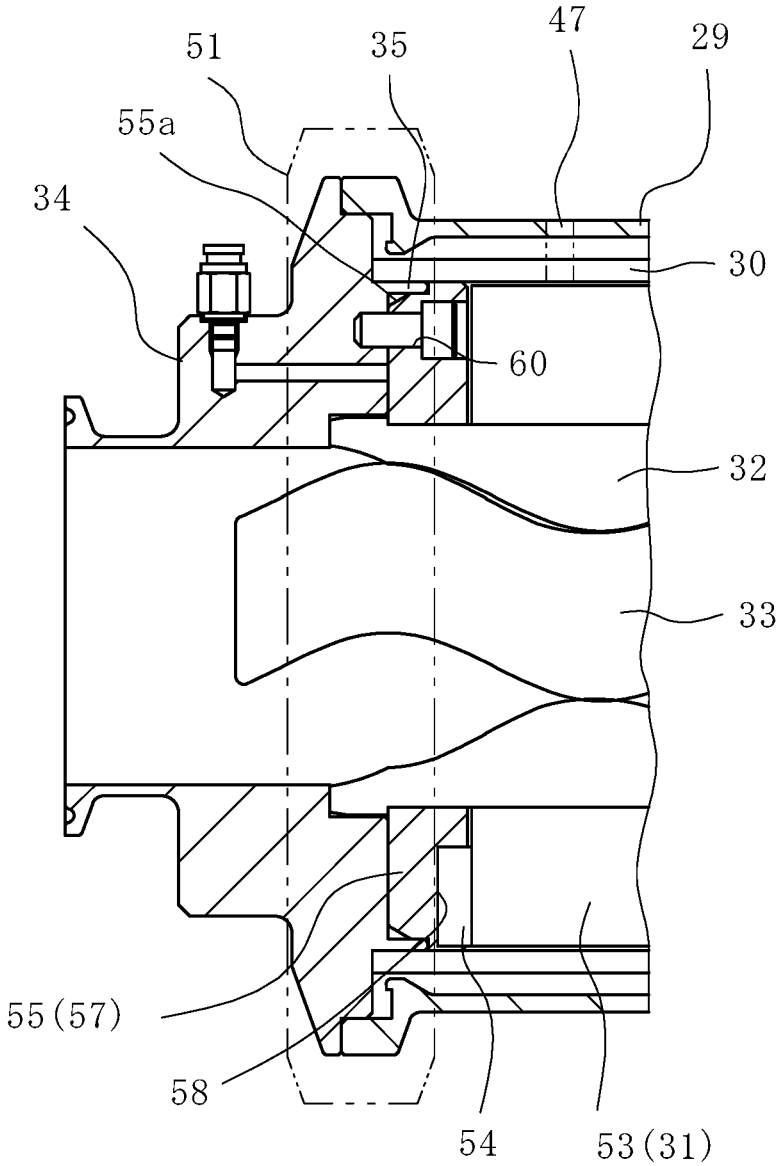
FIG. 4 is a partial cross-sectional view showing one end side of a pump body in FIG. 1.

As shown in FIG. 4, an end stud 34 is mounted on one end portion of the third casing 29. The end stud 34 has a hollow cylindrical shape. An inner peripheral surface of the end stud 34 on one end side is expanded toward an outer diameter side, and one end portion of the stator 32 is disposed in the expanded portion in a press-fitted state. An annular projecting portion 35 is formed on one end surface of the end stud 34. As described later, the annular projecting portion 35 plays a role of pushing two adaptor portions 57 which form a first adaptor 55 toward the inner diameter side thus bringing inner surfaces of the adaptor portions 57 into pressure contact with an outer surface of the stator 32. A connecting portion between the third casing 29 and the end stud 34 is sealed by a packing or the like not shown in the drawing.

Figure 5:
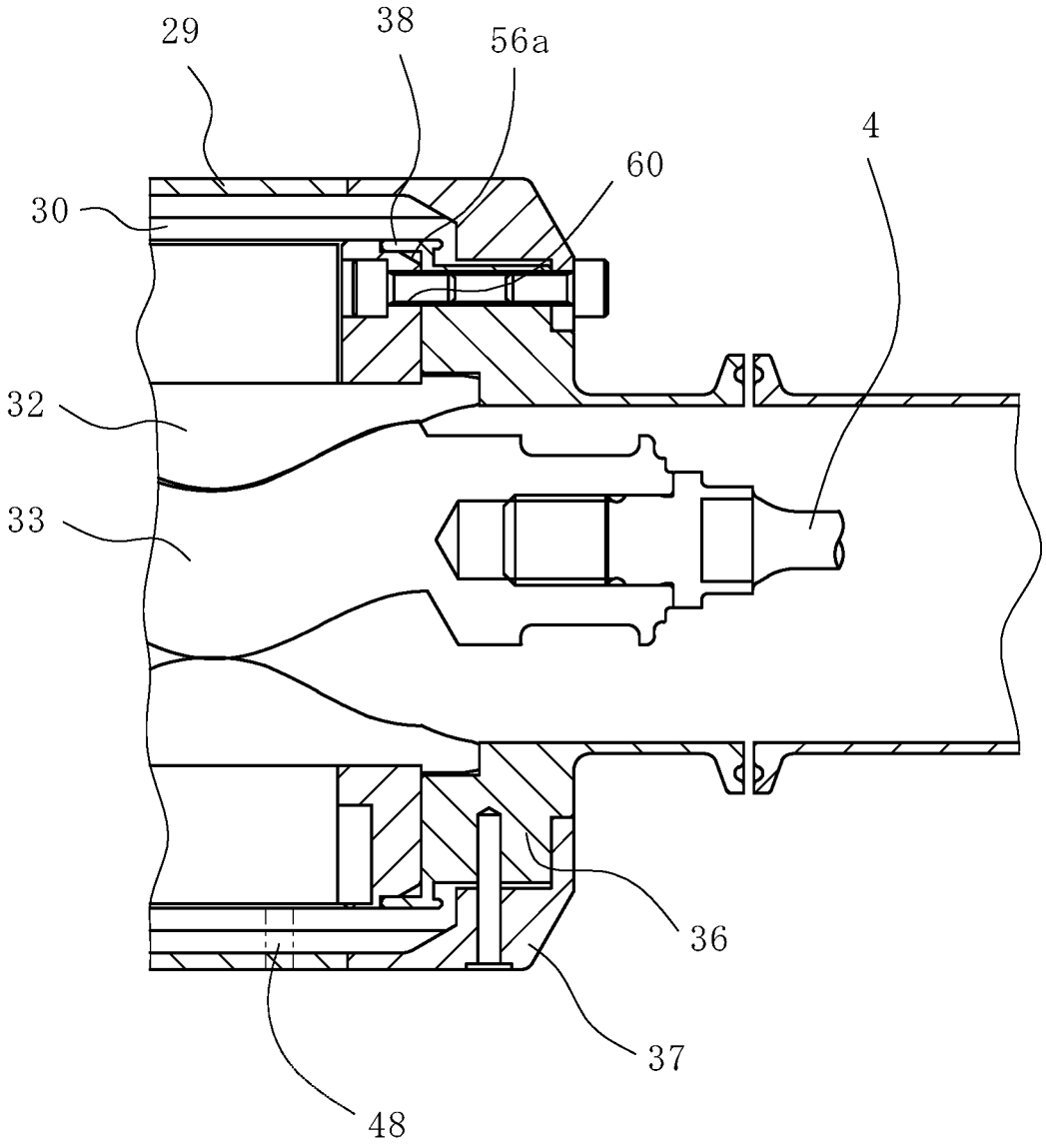
FIG. 5 is a partial cross-sectional view showing the other end side of the pump body in FIG. 1.

As shown in FIG. 5, a closing member 36 and a protection cover 37 are mounted on the other end portion of the third casing 29. An inner peripheral surface of the closing member 36 on one end side is expanded toward the outer diameter side, and the other end portion of the stator 32 is disposed in the expanded portion in a press-fitted state. One end surface of the closing member 36 faces the inside of the third casing 29, and an annular projecting portion 38 is formed on an outer peripheral edge of the closing member 36. As described later, the annular projecting portion 38 pushes two adaptor portions 57 of the second adaptor 56 toward the inner diameter side thus bringing inner surfaces of the adaptor portions 57 into pressure contact with the outer surface of the stator 32. A connecting portion between the third casing 29 and the closing member 36 is sealed by a packing or the like not shown in the drawing. The protection cover 37 covers the other end portion of the third casing 29 and a portion of the closing member 36.

Returning to FIG. 1, an inlet port 39 is connected to a lower center portion of the third casing 29, and an outlet port 40 is connected to an upper center portion of the third casing 29. A first open/close valve 41, a control valve 42, a first pressure gauge 43, and a regulator 44 (pressure regulator) are disposed on a middle portion of a pipe connected to the inlet port 39 in order from a third casing side. With such a configuration, a pressure of a supplied control fluid (the fluid being preferably an incompressible fluid represented by a liquid although the fluid may be a gas) is adjusted by the regulator 44, and the fluid can be filled into a hermetically sealed space 52 described later through the control valve 42 whose operation position is switched to an open position, the opened first open/close valve 41, and the inlet port 39. A second pressure gauge 45 and a second open/close valve 46 are disposed on a middle portion of a pipe connected to the outlet port 40 in order from the third casing side. The second pressure gauge 45 detects a pressure of the control fluid in the hermetically sealed space 52. A detected pressure is inputted to a control device not shown in the drawing. The control device adjusts a flow rate and a pressure of the control fluid which is filled in the sealed space 52 through the inlet port 39 based on the inputted detected pressure, and opens/closes the second open/close valve 46 so that the control fluid in the hermetically sealed space 52 can be discharged.

An airflow inlet 47 is formed in an upper portion of one end portion of the third casing 29, and an airflow outlet 48 is formed in a lower portion of the other end portion of the third casing 29. The airflow inlet 47 and the airflow outlet 48 are made to communicate with an intermediate region defined between the exterior body 31 and the sleeve 30 thus forming a drainage structure. A pipe connected to the airflow inlet 47 is connected to and between the control valve 42 and the first pressure gauge 43. A speed controller 49 and a third open/close valve 50 are mounted on a middle portion of the pipe in a state where the speed controller 49 and the third open/close valve 50 are disposed parallel to each other. The speed controller 49 is provided for restricting an amount of air supplied to the intermediate region. The speed controller 49 is configured to constantly supply a relatively small amount of air to the intermediate region. The third open/close valve 50 is usually held in a closed state, and is opened only when water droplets are generated in the intermediate region. By opening the third open/close valve 50, a large amount of purge air which bypasses the speed controller 49 is blown into the intermediate region so that water droplets are removed. As described above, by making air flow into the intermediate region, it is possible to prevent a phenomenon that vapor generated from a fluid material of a high temperature and vapor used in the SIP permeate through the stator 32 and reach the intermediate region and, then, stagnate in the intermediate region. If the vapor becomes water droplets by being cooled and water stagnates as it is, such water may cause proliferation of bacteria or the like so that an unsanitary state is brought about. By making air flow into the intermediate region, it is possible to prevent the occurrence of such an unsanitary state with certainty. By constantly supplying air to the intermediate region through the speed controller 49, it is hardly conceivable that water droplets stagnate in the intermediate region. Accordingly, a flow passage on a third open/close valve 50 side is not always necessary.

The sleeve 30 is a cylindrical body made of an elastic material. One end opening portion of the sleeve 30 is sandwiched between "an inner peripheral surface of the third casing 29 on one end side" and "the end stud 34 and the first adaptor 55 described later". A flange portion is formed on one end portion of the third casing 29 and the end stud 34 respectively, and these flanges are held by a clamp 51. The other end opening portion of the sleeve 30 is sandwiched between "the inner peripheral surface of the third casing 29 on the other end side and the protection cover 37" and "an outer peripheral surface of the closing member 36 and an outer peripheral surface of the annular projecting portion 38 of the closing member 36". With such a configuration, the annular hermetically sealed space 52 is formed between the sleeve 30 and the third casing 29. A control fluid is filled into the hermetically sealed space 52 through the inlet port 39, and is discharged from the hermetically sealed space 52 through the outlet port 40.

Figure 6A:
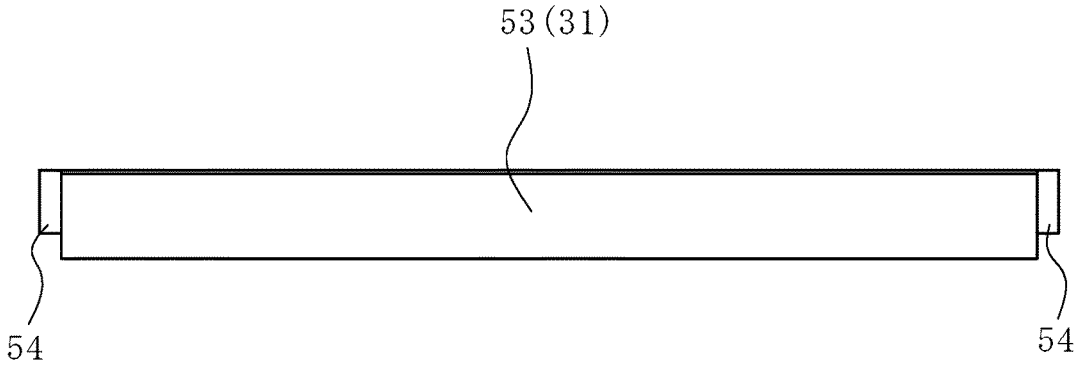
FIG. 6A is a front view of an exterior body shown in FIG. 1.
Figure 6B:
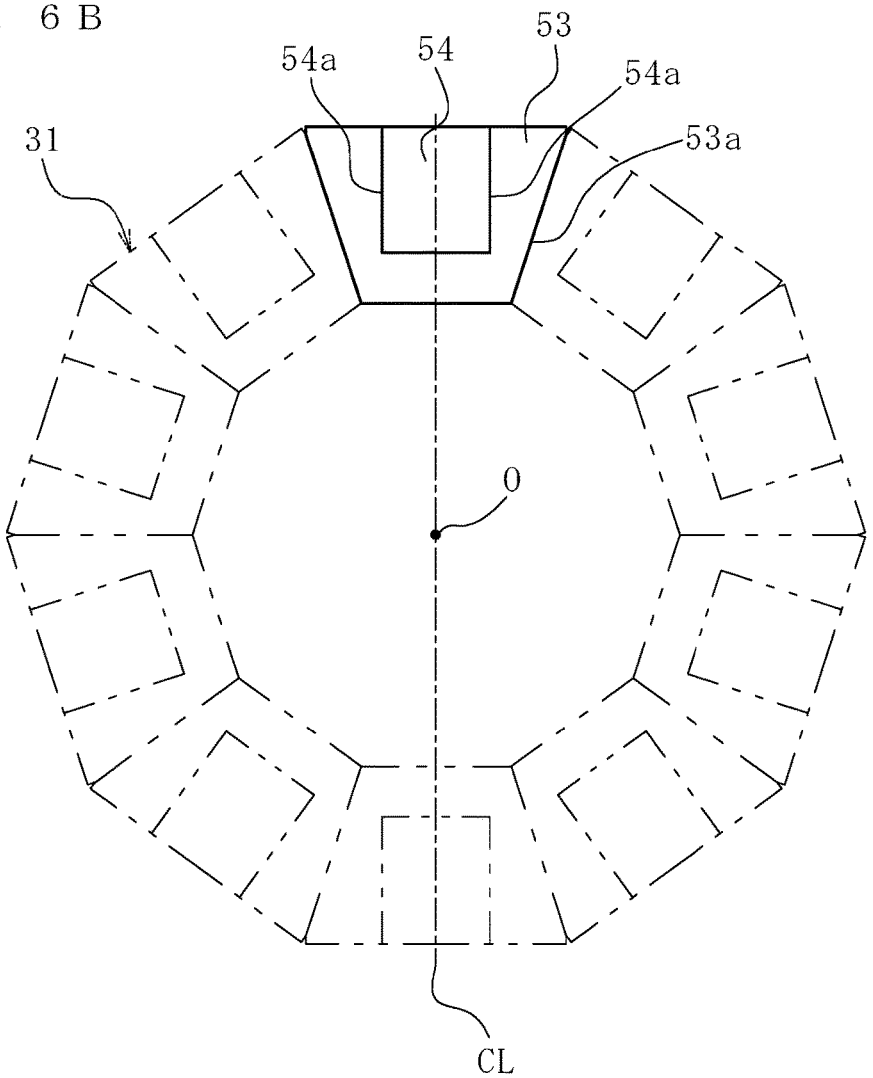
FIG. 6B is a side view of the exterior body.

As shown in FIG. 6, the exterior body 31 is formed of a plurality of (ten in this embodiment) exterior portions 53 made of a synthetic resin material. Each exterior portion 53 is formed of a rod-shaped body having an isosceles trapezoid shape in cross section, and a protrusion 54 having a square shape in cross section projects from both end portions of each exterior portion 53. The protrusions 54 function as engaging portions to be engaged with recessed portions 58 (portions to be engaged) formed on the adaptors 55, 56 described later. By bringing planar surfaces of leg portions (leg portion inclined surfaces 53*a*) of the exterior portions 53 into contact with each other with upper bottom portions of the isosceles trapezoid shapes disposed on an inner diameter side, the exterior portions 53 are brought into an annularly continuous state. In state where the exterior portions 53 are in an annularly continuous state, both side surfaces 54*a* of each protrusion 54 are disposed parallel to a straight line which passes the center of each exterior portion 53 from the center O of the annularly connected protrusions 54 and extends to the outer diameter direction (only one straight line indicated by symbol "CL" shown in FIG. 6B).

Figure 7A:
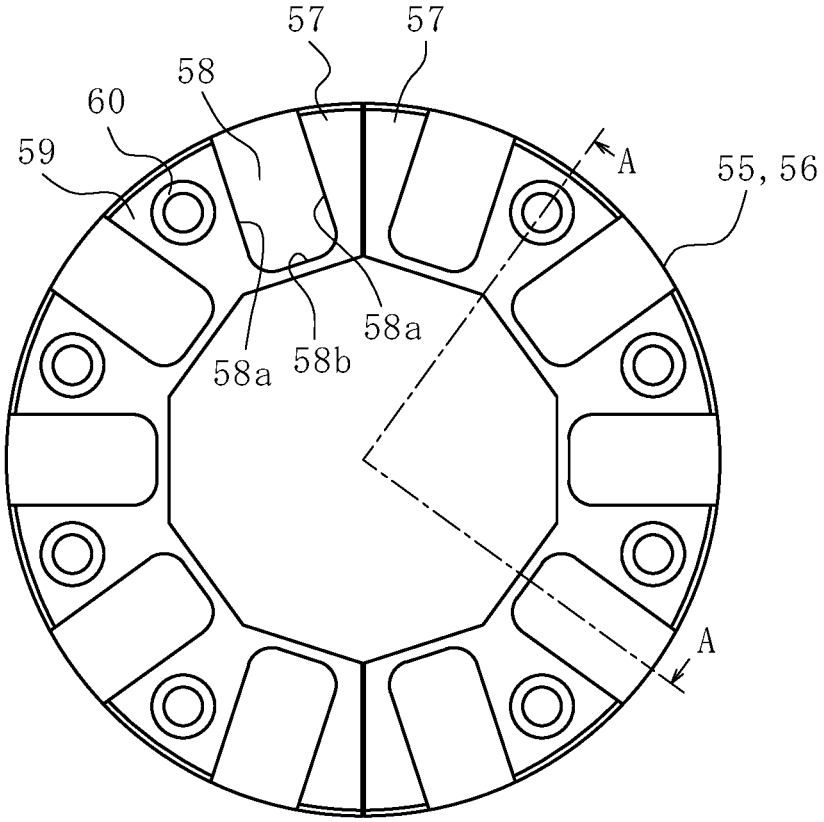
FIG. 7A is a front view of an adaptor shown in FIG. 1.
Figure 7B:
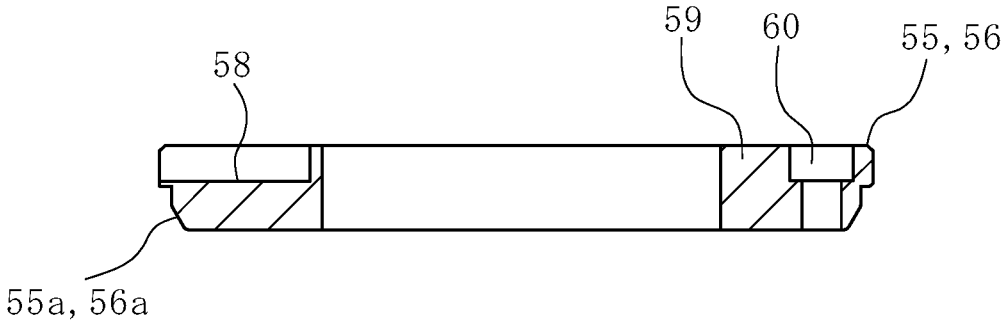
FIG. 7B is a cross-sectional view of the adaptor taken along a line A-A in FIG. 7A.

At both end portions of the exterior body 31, the first adaptor 55 and the second adaptor 56 each of which is one example of a guide member are disposed respectively. As shown in FIG. 7, although each adaptor 55, 56 has a donut shape, in this embodiment, each adaptor 55, 56 having the donut shape is formed by combining two adaptor portions 57. An inner surface of each adaptor 55, 56 is formed into a polygonal shape (a regular decagonal shape in this embodiment) in conformity with a shape of an outer peripheral surface of the stator 32 described later. Ten recessed portions 58 are formed on one surface of each adaptor 55, 56 equidistantly in the circumferential direction, and a screw hole 60 having a stepped shape is formed in each pedestal portion 59 defined between two recessed portions 58. The protrusions 54 of the respective exterior portions 53 are disposed in the respective recessed portions 58. Each recessed portion 58 has oppositely facing surfaces 58*a* which guide both side surfaces 54*a* of the protrusion 54 of the exterior portion 53 and an inner side surface 58*b* disposed on the inner diameter side, and each recessed portion 58 is opened toward the outer diameter side. By forming the recessed portions 58 into such a shape, the protrusions 54 of the respective exterior portions 53 are positioned in the circumferential direction while the protrusions 54 are movable in the radial direction. As described above, the recessed portions 58 form the portions to be engaged which are engaged with the protrusions 54 of the exterior portions 53. On the other surface side of each adaptor 55, 56, a conical-shaped tapered surface 55*a*, 56*a* where a diameter of an outer peripheral surface is gradually decreased is formed respectively.

The first adaptor 55 is fixed to the end stud 34 by bolts by making use of the screw holes 60, (see FIG. 4). With such fixing by bolts, the tapered surface 55*a* of the first adaptor 55 is pushed by the annular projecting portion 35 of the end stud 34 so that the tapered surface 55*a* is moved toward the inner diameter side. That is, the tapered surface 55*a* and the annular projecting portion 35 form the slide structure. With such a configuration, an inner peripheral surface of the first adaptor 55 is brought into pressure contact with an outer peripheral surface of the stator 32 so that a favorable sealed state can be acquired. The second adaptor 56 is fixed to the closing member 36 by bolts by making use of the screw holes 60 (see FIG. 5). With such fixing by bolts, the tapered surface 56*a* of the second adaptor 56 is pushed by the annular projecting portion 38 of the closing member 36 so that the tapered surface 56*a* is moved toward the inner diameter side. With such a configuration, an inner peripheral surface of the second adaptor 56 is brought into pressure contact with an outer peripheral surface of the stator 32 so that a favorable sealed state can be acquired.

Figure 8:
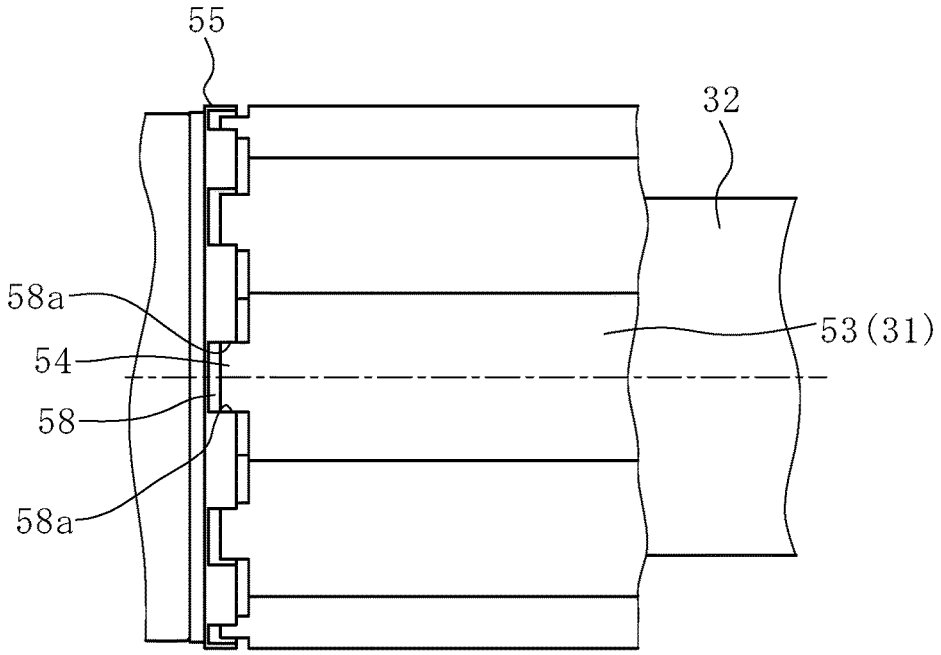
FIG. 8 is a partial front view showing an engagement state shown in FIG. 1 between protrusions of an exterior portion and recessed portions formed in the adaptor.

The first adaptor 55 and the second adaptor 56 are disposed at both end portions of each exterior portion 53 and hence, the movement of each exterior portion 53 in the circumferential direction is restricted. In each exterior portion 53, the protrusion 54 is movable in the recessed portion 58 formed in the adaptor 55, 56 in the radial direction of the stator 32. That is, the exterior portions 53 are movable between a first position where the exterior portions 53 are capable of compressing the stator 32 and a second position where the exterior portions 53 alleviate a compression state of the stator 32. Each exterior portion 53 is formed of a rigid body. By making a control fluid flow into the hermetically sealed space 52, the exterior portions 53 are moved inwardly so that the exterior portions 53 uniformly compress the whole stator 32 inwardly. Accordingly, there is no defect such as the generation of pulsation caused by variations in a contact pressure of the stator 32 to the rotor 33 in the axial direction. When the exterior portions 53 are moved radially inwardly, further movement of the exterior portions 53 is prevented at a position where the leg portion inclined surfaces 53*a* are brought into contact with each other. Accordingly, there is no possibility that a contact pressure of the stator 32 to the rotor 33 is excessively increased. To be more specific, as shown in FIG. 8, the exterior portions 53 are movable in the radial direction of the stator 32 (direction connecting a depth side and a viewer's side which is orthogonal to a surface of paper on which a drawing is made with respect to the exterior portion 53 positioned on a center line shown in FIG. 8). On the other hand, both side surfaces of the respective protrusion 54 of the exterior portion 53 are guided by the both oppositely facing surfaces 58*a* of the recessed portion 58 formed on the respective adaptors 55, 56 (only the first adaptor 55 shown in FIG. 8) and hence, each exterior portion 53 is not movable in the circumferential direction of the stator 32 (in the vertical direction in FIG. 8). The exterior portions 53 may be configured such that, at the second position, a pressing force of the exterior portions 53 applied to the stator 32 becomes zero so that the stator 32 is not compressed at all. However, the exterior portions 53 are not limited to such a configuration. It is sufficient that the exterior portions 53 are configured such that at least a compression state of the stator 32 is alleviated compared to a compression state of the stator 32 at the first position. The increase of a contact pressure of the stator 32 to the rotor 33 can be suppressed not only by a contact between the leg portion inclined surfaces 53*a* of the exterior portions 53 but also by a contact between the protrusions 54 of the exterior portions 53 and the inner side surfaces 58*b* of the recessed portions 58 formed on the adaptors 55, 56.

The stator 32 is formed of a cylindrical body made of an elastic material such as rubber or a resin which is desirably selected corresponding to a material to be conveyed (for example, silicone rubber or fluororubber (used when a fluid material is cosmetics or the like containing silicone oil)). In this embodiment, the stator 32 is formed into a hollow cylindrical shape having a regular decagonal shape in cross section. An inner peripheral surface of a center hole 32*a* of the stator 32 is formed of single-stage or multiple-stage n-start female threads.

The rotor 33 has a shaft body made of a metal material such as stainless steel and having an outer peripheral surface formed of single-stage or multiple-stage (n−1)-start male threads. The rotor 33 is disposed in the inside of the center hole 32*a* of the stator 32 and forms a continuous conveyance space 32*b* extending in the longitudinal direction of the rotor 33. One end portion of the rotor 33 is connected to the coupling rod 4 on the casing side. Upon receiving a driving force from a drive unit (not shown in the drawing), the rotor 33 rotates in the inside of the stator 32 and, at the same time, revolves along an inner peripheral surface of the stator 32. That is, the rotor 33 eccentrically rotates in the center hole 32*a* of the stator 32 so that the fluid material in the conveyance space 32*b* can be conveyed in the longitudinal direction of the rotor 33.

Next, a method for assembling the uniaxial eccentric screw pump having the above-mentioned configuration is described.

First, the closing member 36 is integrally mounted by press-fitting or the like on one end portion of the stator 32 in which the rotor 33 is inserted. Then, the second adaptor 56 is fixed to the closing member 36 by bolts. The second adaptor 56 is formed of two adaptor portions 57. By fixing the second adaptor 56 to the closing member 36 by bolts, the tapered surface 56*a* is pushed by the annular projecting portion 38 of the closing member 36 and is moved toward the inner side. Accordingly, the inner surface of the second adaptor 56 is brought into close contact with the outer surface of the stator 32 so that a favorable sealed state can be acquired. In the same manner, in a state where the end stud 34 is integrally mounted on the other end portion of the stator 32, the first adaptor 55 is fixed to the end stud 34 by bolts. In the same manner as the second adaptor 56, the first adaptor 55 is also formed of two adaptor portions 57. By fixing the first adaptor 55 to the end stud 34 by bolts, the tapered surface 55*a* is pushed by the annular projecting portion 35 of the end stud 34 and is moved toward the inner side. Accordingly, the inner surface of the first adaptor 55 is brought into close contact with the outer surface of the stator 32 so that a favorable sealed state can be acquired.

Subsequently, the exterior portions 53 are respectively arranged along respective outer surfaces of the stator 32. In this operation, the protrusions 54 of the exterior portions 53 are positioned in the recessed portions 58 formed in the first adaptor 55 and the second adaptor 56. With such an operation, although the respective exterior portions 53 are movable in the radial direction with respect to the stator 32, the positions of the respective exterior portions 53 in the circumferential direction are restricted. The sleeve 30 is disposed around the exterior body 31 formed by arranging ten exterior portions 53. Then, these members are housed in the third casing 29. One end portion of the third casing 29 is closed by the end stud 34, and the other end portion of the third casing 29 is closed by the closing member 36 and the protection cover 37. Through these steps, the pump body 2 is completed.

One end portion of the coupling rod 4 is connected to the rotor 33. One end opening portion of the first casing 1 is brought into contact with the protection cover 37, and the first casing 1 and the protection cover 37 are connected to each other by a clamp not shown in the drawing thus covering the coupling rod 4.

Figure 9:
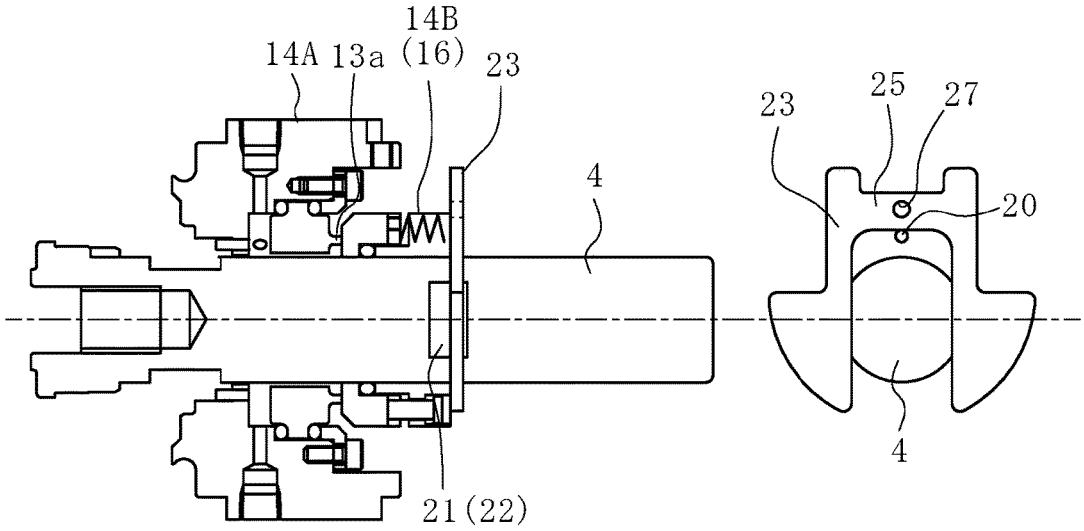
FIG. 9 is a cross-sectional view showing a state at the time of starting mounting of the set plate for temporarily fixing a rotary ring shown in FIG. 1.
Figure 10:
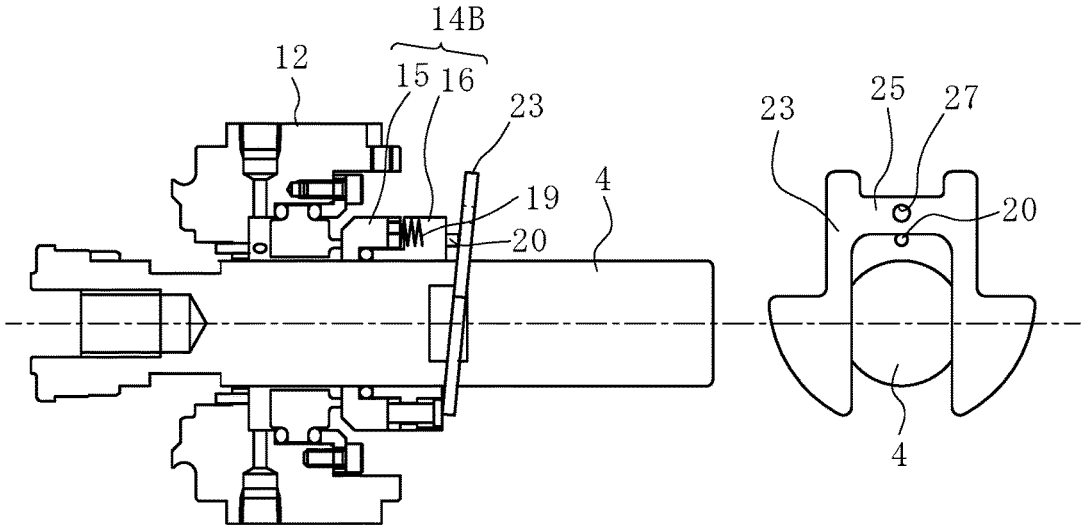
FIG. 10 is a cross-sectional view showing a state where the rotary ring is pushed by the set plate from a state shown in FIG. 9.
Figure 11:
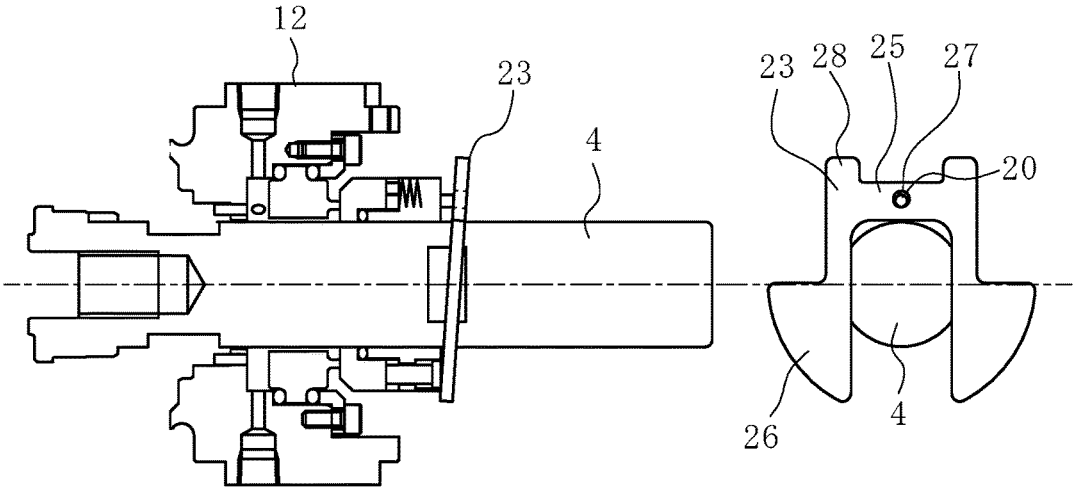
FIG. 11 is a cross-sectional view showing a state where the set plate is made to descend from a state shown in FIG. 10.
Figure 12:
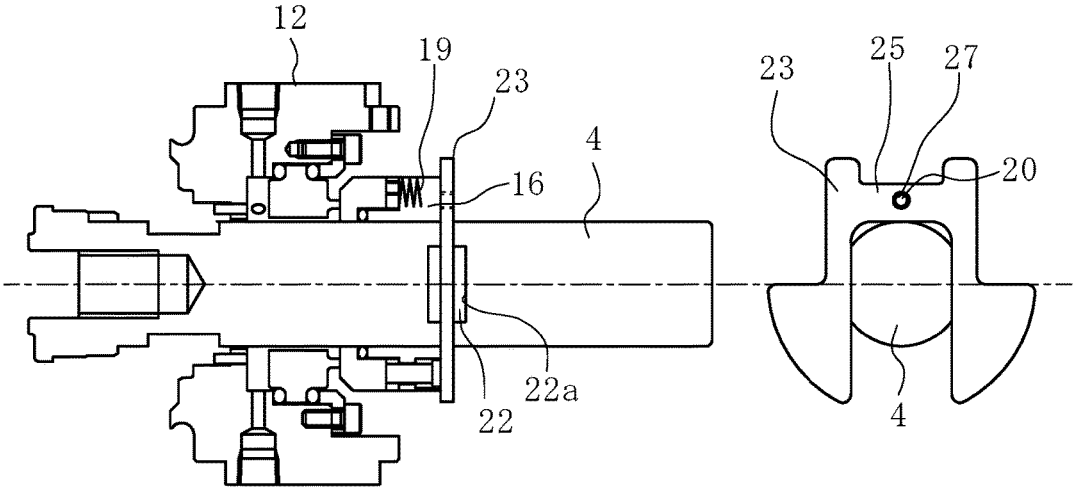
FIG. 12 is a cross-sectional view showing a state where a positioning pin of the rotary ring is inserted into a pin hole formed in the set plate from a state shown in FIG. 11.
Figure 13:
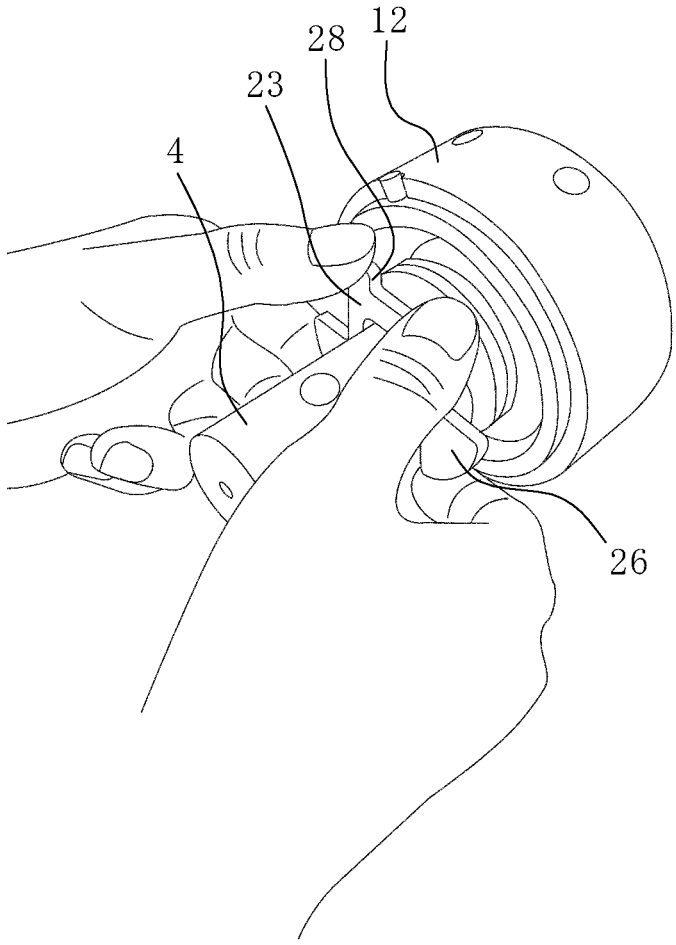
FIG. 13 is a perspective view showing a state where the set plate is operated so as to bring the set plate into a state shown in FIG. 10 from a state shown in FIG. 9.

As shown in FIG. 9, the mechanical seal 12 is mounted on the other end portion of the coupling rod 4. First, a fixed ring 14A is mounted on the coupling rod 4. Subsequently, a rotary ring 14B is fitted on the coupling rod 4 and is brought into contact with an end surface (annular projecting portion 13*a*) of the fixed ring 14A. Then, the leg portions 24 of the set plate 23 are moved in a sliding manner to the groove portions 22 (flat surfaces 21) from an outer diameter side of the coupling rod 4. After a lower edge of the connecting portion 25 of the set plate 23 is brought into contact with the positioning pin 20 of the annular portion 16 of the rotary ring 14B, as shown in FIG. 13, the expanded portions 26 are pushed by forefingers while hooking a thumb on the operation lugs 28 of the set plate 23 and pulling the operation lugs 28. With such operations, as shown in FIG. 10, the set plate 23 is inclined in a state where the set plate 23 is supported by the groove portions 22 so that the positioning pin 20 is removed from the lower edge of the connecting portion 25 whereby the set plate 23 can be further moved in a sliding manner. At this stage of operation, the set plate 23 plays a role as a jig which facilitates pushing of the rotary ring 14B. Then, as shown in FIG. 11, the set plate 23 is moved in a sliding manner until the lower edge of the connecting portion 25 is brought into contact with the outer peripheral surface of the coupling rod 4 and, thereafter, as shown in FIG. 12, the set plate 23 is returned to an original position from an inclined position, and the positioning pin 20 is inserted into the pin hole 27 formed in the set plate 23. By removing hands at this stage of operation, the set plate 23 is pushed by the annular portion 16 of the rotary ring 14B which is biased by the spring 19 so that the set plate 23 is brought into contact with one side surface 22*a* of the groove portion 22 whereby the set plate 23 is positioned (see FIG. 9). As described above, the rotary ring 14B can be easily mounted on (temporarily fixed to) the coupling rod 4 without requiring a tool. By performing the above-mentioned procedure in a reverse manner, the rotary ring 14B mounted on the coupling rod 4 can be easily removed.

After the mechanical seal 12 is mounted on the coupling rod 4, the coupling rod 4 is connected to the drive transmission portion 6. That is, as shown in FIG. 2, a distal end portion of the coupling rod 4 is inserted into the cylindrical portion 10 of the drive shaft 9, and an opening end surface of the sealing cover 14*a* is brought into contact with an opening end surface of the second casing 7. Then, the coupling rod 4 and the drive shaft 9 are connected with each other using the connecting pin 11. At this stage of operation, the distal end opening portion 9*a* of the cylindrical portion 10 pushes the set plate 23 and hence, the set plate 23 is separated from the side surfaces 22*a* of the groove portions 22. A length of the cylindrical portion 10 in the axial direction is set to a value which allows the set plate 23 and the rotary ring 14B to be moved to proper positions so that the spring 19 is brought into a proper compression state.

Next, the manner of operation of the uniaxial eccentric screw pump having the above-mentioned configuration is described.

A filling amount of a control fluid filled into the hermetically sealed space 52, a kind of fluid material, and a relationship between a rotational speed of the rotor 33 and a discharge pressure are set in advance. For example, the sleeve 30 is positioned at an initial state where a filling amount of a control fluid to be filled into the hermetically sealed space 52 is set to a minimum value. For respective kinds of the fluid material, a relationship between a rotational speed of the rotor 33 and a discharge pressure is stored in the form of a data table. By performing a plurality of similar processing while changing a filling amount of a control fluid filled into the hermetically sealed space 52 in a stepwise manner, a data table is completed.

When a fluid material is discharged from a tank or the like, first, the first open/close valve 41 is opened or a similar operation is performed so that a control fluid is filled into the hermetically sealed space 52 formed by the third casing 29 and the sleeve 30. The exterior body 31 formed of the plurality of exterior portions 53 is disposed on the end portion of the stator 32. Both end portions of the respective exterior portions 53 are supported by the adaptors 55, 56. With such a configuration, the stator 32 is movable in the radial direction. Accordingly, by changing a filling amount of a control fluid filled into the hermetically sealed space 52 thus making the stator move in the radial direction, an interference between the stator 32 and the rotor 33 can be adjusted. A filling amount of the control fluid filled into the hermetically sealed space 52 is decided by looking up the data table for discharging a fluid material at a desired discharge pressure corresponding to a rotational speed of the rotor 33. In this case, it is preferable to use an incompressible fluid as a control fluid because it is possible to make a relationship between a filling amount and a discharge pressure stable with no fluctuation with the use of an incompressible fluid.

A discharge pressure can be increased as follows. By increasing a filling amount of the control fluid to be filled into the hermetically sealed space 52, the sleeve 30 is elastically deformed toward the inside so that the exterior portions 53 are made to approach to each other. By making exterior portions 53 approach to each other, the stator 32 is pressurized so that a contact pressure of the stator 32 to the rotor 33 is increased. On the other hand, a discharge pressure can be suppressed as follows. By suppressing a filling amount of a control fluid, a deformation amount of the sleeve 30 is suppressed so that the exterior portions 53 are not made to approach to each other considerably. By making the exterior portions 53 not approach to each other considerably, a contact pressure of the stator 32 to the rotor 33 can be suppressed.

After a filling amount of a control fluid is adjusted, the drive unit not shown in the drawing is driven so as to rotate the rotor 33 at a rotational speed set in advance by way of the coupling rod 4. A rotational speed at this stage of operation is decided by taking into account a discharge amount per unit time. By rotating the rotor 33, a conveyance space formed by the inner peripheral surface of the stator 32 and the outer peripheral surface of the rotor 33 is moved in the longitudinal direction of the stator 32 and the rotor 33. A fluid material supplied through the connecting pipe 5 is sucked into the conveyance space through the first casing 1, and is conveyed to the end stud 34. The fluid material which reaches the end stud 34 is further conveyed to another place.

During an operation of the uniaxial eccentric screw pump, a state is created where air continuously flows in the intermediate region defined between the exterior body 31 and the sleeve 30 in a direction toward the airflow outlet 48 from the airflow inlet 47. With such a configuration, even when a fluid material of a high temperature which generates vapor or vapor per se is to be conveyed, there is no possibility that vapor which permeates the stator 32 stagnates in the third casing 29 so that it is possible to discharge such vapor with certainty. Even when a state arises where water droplets stagnate in the intermediate region by any chance, it is sufficient to supply a large amount of air to the inside of the intermediate region by opening the third open/close valve 50.

As described previously, the whole outer peripheral surface of the stator 32 is held by the exterior body 31. Further, the rotation of the exterior body 31 in the circumferential direction is prevented by the adaptors 55, 56 disposed on both end portions of the exterior body 31. That is, the whole outer peripheral surface of the stator 32 is held by the whole inner surface of the exterior body 31 whose rotation is prevented by the adaptors 55, 56 so that a torque load generated along with the rotation of the rotor can be dispersed. Accordingly, it is possible to prevent the occurrence of repeated deformation where the stator 32 is elastically deformed in the rotation direction along with the rotation of the rotor 33 and, thereafter, the stator 32 is restored to an original shape. Accordingly, it is possible to prevent the occurrence of breakage of the stator 32.

Figure 14A:
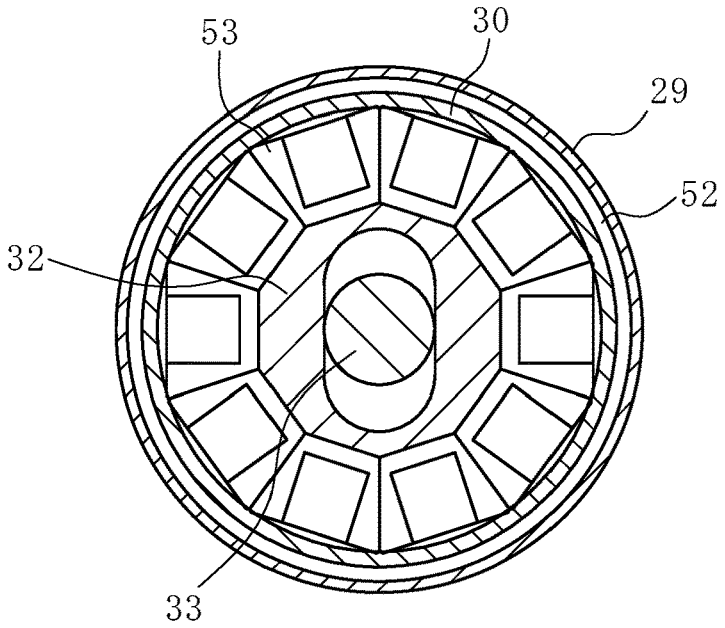
FIG. 14A is a transverse cross-sectional view of the pump body shown in FIG. 1 when exterior portions are positioned at innermost diameter positions.
Figure 14B:
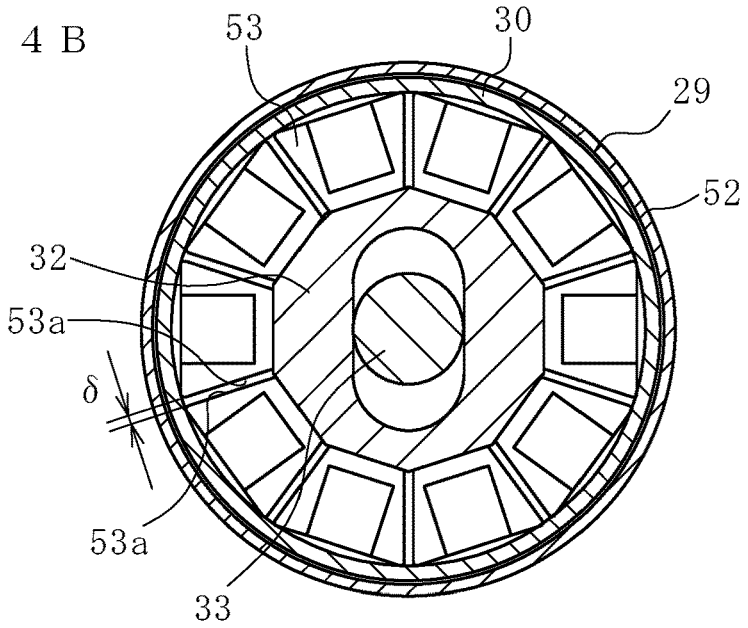
FIG. 14B is a transverse cross-sectional view showing a state where the respective exterior portions are moved to an outer diameter side from a state shown in FIG. 14A.

As shown in FIG. 14, the stator 32 is formed into a decagonal shape in transverse cross section, and the exterior body 31 is formed of ten exterior portions 53 corresponding to the number of sides of the stator 32 in transverse cross section. Accordingly, the stator 32 and the respective exterior portions 53 can be brought into contact with each other or can be separated from each other in a state where the outer surfaces of the stator 32 and the inner surfaces of the respective exterior portions 53 oppositely face each other. Further, by increasing the number of exterior portions 53, compared to the case where the number of exterior portions 53 is small, it is possible to decrease a gap 8 between the leg portion inclined surfaces 53*a* of the exterior portions 53 disposed adjacently to each other when the exterior portions 53 are moved in the outer diameter direction. With such a configuration, in moving the exterior portions 53 to the stator 32 in a direction toward the inner diameter side from the outer diameter side, it is possible to prevent the occurrence of a defect that the stator 32 is bitten by the gap 6 so that the stator 32 is damaged.

Further, the sleeve 30 is disposed on the outer diameter side of the stator 32 and hence, even when a crack or the like is formed on the stator 32, there is no possibility that outside air or the like intrudes into the stator 32 or a fluid material in the stator 32 leaks to the surrounding so that the surrounding area is contaminated.

Also when a fluid material of a high temperature is conveyed such as when the inside of the stator 32 is to be sterilized, it is preferable to suppress a filling amount of a control fluid filled into the hermetically sealed space 52 (or set a filling amount of a control fluid filled into the hermetically sealed space 52 to zero). The stator 32 is thermally expanded in the radial direction by the fluid material of a high temperature. In this case, by suppressing a filling amount of a control fluid, the respective exterior portions 53 are become movable toward the outer diameter side. Accordingly, the stator 32 can be expanded toward the outer diameter side so that it is possible to prevent the occurrence of a defect that the stator 32 is expanded only toward the inner diameter side thus interrupting the rotation of the rotor 33.

It is also preferable to adjust a filling amount of a control fluid by taking into account an amount of wear of the stator 32 or the rotor 33 generated along with the use of the stator 32 and the rotor 33. That is, when the stator 32 and the rotor 33 are worn, an inflow amount of the control fluid is increased by also taking into account such an amount of wear thus adjusting an interference between the stator 32 and the rotor 33 to a desired value.

The present invention is not limited to the configurations described in the embodiment, and various modifications are conceivable.

In the embodiment, the exterior body 31 is formed of ten exterior portions 53. However, the number of exterior portions 53 is not particularly limited, and the exterior body 31 may be formed of six, eight, or twelve or more exterior portions 53. The number of exterior portions 53 may be set to an odd number. However, to consider a balance of the exterior body 31, it is desirable to set the number of exterior portions 53 to an even number. By increasing the number of exterior portions 53, a gap size δ (see FIG. 14 B) formed between the exterior portions 53 disposed adjacently to each other can be decreased when the exterior portions 53 are moved toward the outer diameter direction. Accordingly, when the stator 32 is expanded or contracted in the radial direction, there is no possibility of the occurrence of a defect such as biting.

In the embodiment, the protrusions 54 are formed on the exterior body 31 as the engaging portions, and the recessed portions 58 are formed on the adaptors 55, 56 as the portions to be engaged. However, the recessed portions may be formed on the exterior body 31 as the engaging portions, and the protrusions may be formed on the adaptors 55, 56 as the portions to be engaged.

Figure 15A:
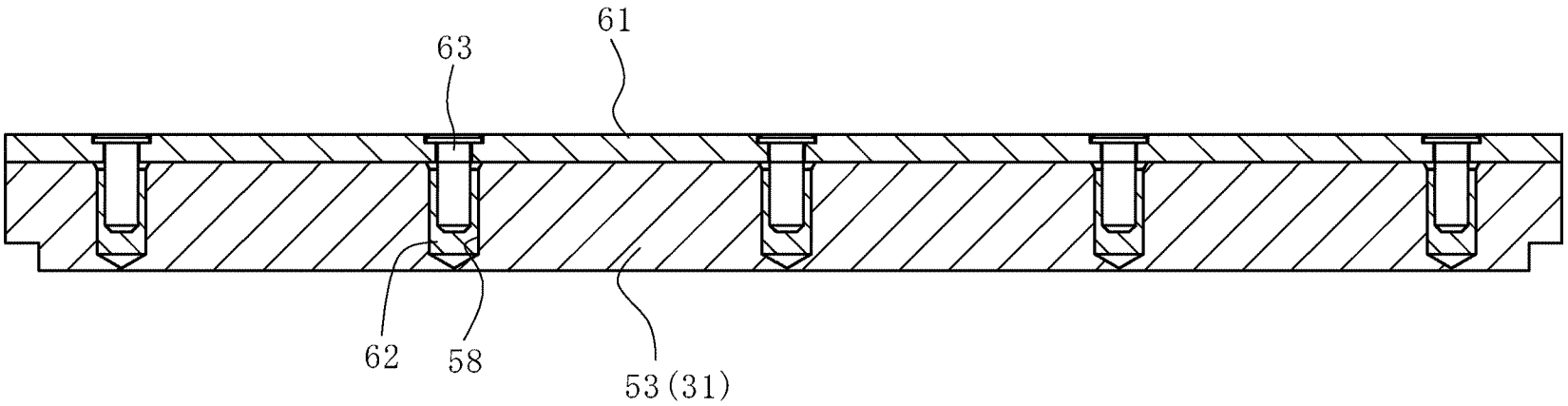
FIG. 15A is a front cross-sectional view of an exterior body according to another embodiment.
Figure 15B:
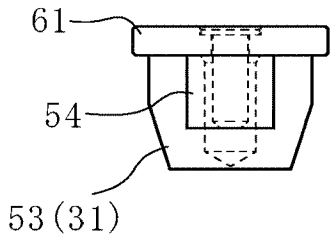
FIG. 15B is a transverse cross-sectional view of the exterior body.
Figure 15C:
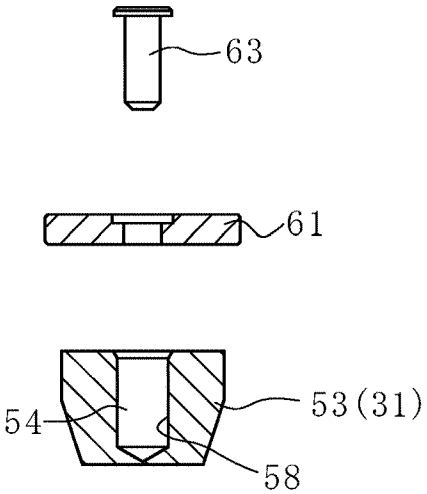
FIG. 15C is an exploded view of the exterior body shown in FIG. 15B.

In the embodiment, the entire exterior body 31 is formed of only a synthetic resin material. However, as shown in FIG. 15, a metal-made reinforcing plate 61 may be integrally mounted on the exterior body 31 as a reinforcing body. That is, a plurality of recessed portions 58 are formed on a back surface of each exterior portion 53 which forms the exterior body 31 at predetermined intervals along the longitudinal direction, and an inner nut 62 is integrally formed with each recessed portion 58. Stepped holes are formed in the reinforcing plate 61 and bolts 63 are threadedly engaged with the respective inner nut 62 through the stepped holes so that the reinforcing plate 61 is integrally mounted on the exterior portion 53.

With the use of the exterior portions 53 each of which is reinforced by the metal-made reinforcing plate 61, inner surfaces of the exterior portions 53 made of a synthetic resin material are brought into contact with the stator 32 disposed inside the exterior portions 53 and hence, the stator 32 is minimally damaged, and a favorable face contact state can be acquired between the stator 32 and the exterior portions 53. Further, rigidity of each exterior portion 53 per se is increased by the reinforcing plate 61 and hence, the exterior portion 53 is minimally deformed (bent) due to heat, expansion of the stator 32 or the like. Accordingly, a state where the stator 32 is sufficiently held by the exterior body 31 can be ensured.

The reinforcing plate 61 may be formed on each exterior portion 53 by insert molding. In this case, a rod-shaped body made of a hard material may be used in place of the reinforcing plate 61. Provided that the deformation of the exterior body 31 can be prevented, a length of the rod-shaped body may be set smaller than a length of the exterior body 31.

Alternatively, in place of mounting the reinforcing plate 61 on the exterior body 31, projection ridges or grooves which extend in the longitudinal direction may be formed on the exterior body 31 so as to make the exterior body 31 have a cross-sectional shape which increases rigidity of the exterior body 31.

In the embodiment, in mounting the mechanical seal 12 on the coupling rod 4, the rotary ring 14B is temporarily fixed by the set plate 23 and, thereafter, in connecting the coupling rod 4 to the pump body side, the rotary ring 14B is moved to an appropriate position. However, the rotary ring 14B may be positioned at an appropriate position in mounting the set plate 23 on the coupling rod 4. In this case, it is sufficient to set the position of the groove portions 22 such that when the set plate 23 is brought into contact with the side surfaces 22*a* of the groove portions 22, the set plate 23 and the rotary ring 14B are positioned at appropriate positions and the spring 19 is properly compressed.

In the embodiment, only one set plate 23 is used. However, a surface pressure of the mechanical seal 12 may be adjusted by using a plurality of set plates 23 or by preparing a plurality of set plates 23 having different thicknesses. Further, in addition to formation of the pair of groove portions 22 having the flat surfaces 21 on the outer peripheral surface of the coupling rod 4, plural pairs of groove portions 22 may be formed on the outer peripheral surface of the coupling rod 4 while changing positions of the pairs of groove portions 22 in the axis direction and the circumferential direction. By forming the groove portions 22 as described above, a surface pressure of the mechanical seal 12 can be adjusted corresponding to difference in mounting position of the set plate 23.

In the embodiment, although the groove portions 22 formed on the coupling rod 4 have a width size which allows the set plate 23 to move in the axial direction of the coupling rod 4, the groove portions 22 may have a width size substantially equal to a thickness of the set plate 23. However, it is preferable to set a width size of the groove portion 22 larger than a thickness of the set plate 23 to facilitate mounting and removal of the rotary ring 14B.

Figure 16A:
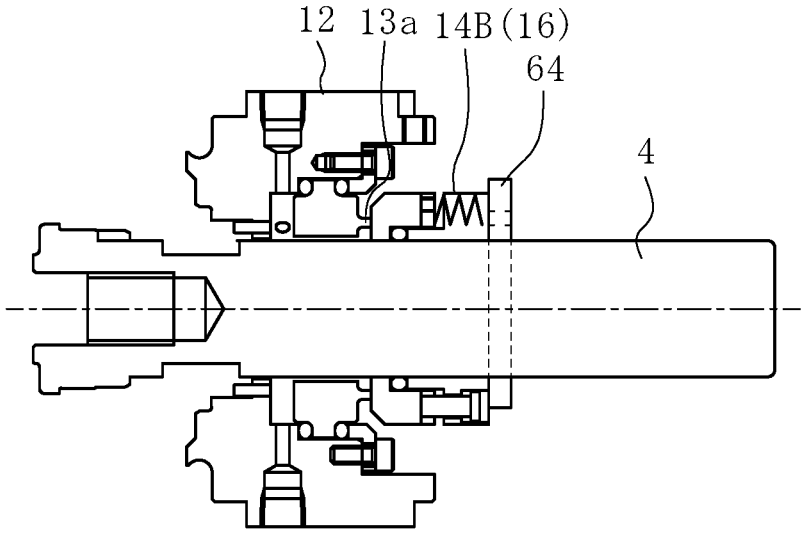
FIG. 16A is a partially enlarged view showing a drive transmission portion according to another embodiment.
Figure 16B:
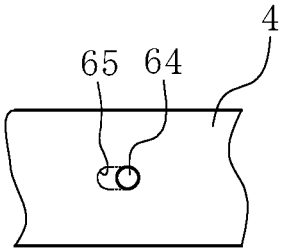
FIG. 16B is a plan view of the drive transmission portion.

In the embodiment, the set plate 23 is used for temporarily fixing (positioning) the rotary ring 14B. However, a pin or the like may be used for temporarily fixing (positioning) the rotary ring 14B. For example, as shown in FIG. 16, a pin 64 may be made to pass through a through hole formed in the coupling rod 4, and the rotary ring 14B may be temporarily fixed (positioned) by the pin 64. In this case, a hole into which the positioning pin 20 formed on the annular portion 16 of the rotary ring 14B is inserted is formed in the pin 64. The through hole which is formed in the coupling rod 4 and into which the pin 64 is made to pass through may be an elongated hole 65 as indicated by a double-dashed chain line in FIG. 16B. By forming the through hole as an elongated hole, in the same manner as the case where the set plate 23 is used, the rotary ring 14B can be pushed by inclining the pin 64.

In the embodiment, the exterior portions 53 are moved in the radial direction by supplying/discharging a control fluid to/from the hermetically sealed space 52. However, the exterior portions 53 may be moved in the radial direction by making use of other drive means such as a solenoid or a spring.

In the embodiment, the protrusions 54 of the respective exterior portions 53 are supported by the adaptors 55, 56 each of which is formed of two divided members. However, the adaptor 55, 56 may be formed of one member or three or more divided members. From a viewpoint of mounting operability, however, it is preferable that the adaptor 55, 56 be formed of divided members.

In the embodiment, the supply of a control fluid to the inside of the hermetically sealed space 52 in the third casing 29 and the supply of air to the intermediate region defined between the exterior body 31 and the sleeve 30 are performed from the same supply source. However, the supply of a control fluid and the supply of air may be performed from different supply sources.

In the embodiment, although the description has been made with respect to the case where the spring 19 is disposed on the rotary ring 14B side, the spring 19 may be disposed on the fixed ring 14A side. That is, the configuration according to the embodiment may be adopted not only by a so-called "rotary" mechanical seal but also by a "static" mechanical seal.

DESCRIPTION OF SYMBOLS

1 first casing
2 pump body
3 stand
4 coupling rod (rotary shaft)
5 connecting pipe
6 drive transmission portion
7 second casing
8 bearing
9 drive shaft
10 cylindrical portion
11 connecting pin
12 mechanical seal
13 seat ring
13*a* annular projecting portion
14A fixed ring
14B rotary ring
14*a* sealing cover
14*b* O ring
15 driven ring
16 annular portion
17 O ring
18 guide pin
19 spring (elastic member)
20 positioning pin
21 flat surface
22 groove portion (mounting portion)
23 set plate (mounting member)
24 leg portion
25 connecting portion
26 expanded portion
27 pin hole
28 operation lug portion
29 third casing
30 sleeve
31 exterior body
32 stator
33 rotor

34 end stud
35 annular projecting portion
36 closing member
37 protection cover
38 annular projecting portion
39 inlet port
40 outlet port
41 first open/close valve
42 control valve
43 first pressure gauge
44 regulator
45 second pressure gauge
46 second open/close valve
47 airflow inlet
48 airflow outlet
49 speed controller
50 third open/close valve
51 clamp
52 hermetically sealed space
53 exterior portion
54 protrusion
55 first adaptor (guide member)
56 second adaptor (guide member)
57 adaptor portion (guide portion)
58 recessed portion
59 pedestal portion
60 screw hole
61 reinforcing plate (reinforcing body)
62 inner nut
63 bolt
64 pin
65 elongated hole

The invention claimed is:

1. A uniaxial eccentric screw pump comprising a casing, the casing including in the inside thereof:

a stator having a female threaded inner peripheral surface;

a rotor configured to be insertable into the stator, and formed of a male threaded shaft body;

an exterior body disposed on an outer diameter side of the stator and configured to be movable between a first position where the exterior body is configured to compress the stator and a second position where the exterior body at least alleviates a compression state of the stator, wherein the exterior body has a pair of end portions that each have a pair of side surfaces;

a pair of adaptors disposed on respective end portions of the exterior body and each being formed with a recessed portion, each of the recessed portions having opposedly facing surfaces for guiding both of the side surfaces of a corresponding one of the respective end portions of the exterior body and having an inner side surface disposed on an inner diameter side of the corresponding adaptor, and each of the recessed portions being opened toward an outer diameter side of the corresponding adaptor; and a sleeve disposed on an outer diameter side of the exterior body and forming a hermetically sealed space between the sleeve and the casing, the sleeve configured to be elastically deformed in an inner diameter side of the sleeve by filling control fluid into the hermetically sealed space.

2. The uniaxial eccentric screw pump according to claim 1 further comprising a mounting portion on which at least one of the adaptors is mounted, wherein the at least one adaptor is formed in an annular shape, and is mounted on the mounting portion.

3. The uniaxial eccentric screw pump according to claim 2, wherein the at least one adaptor is formed of a plurality of adaptor portions which are formed by dividing the at least one adaptor in the circumferential direction, and the plurality of adaptor portions are mounted on the mounting portion in an annularly continuous state.

4. The uniaxial eccentric screw pump according to claim 3, wherein the at least one adaptor and the mounting portion forms a slide structure which is configured to move the respective adaptor portions to an inner diameter side of the at least one adaptor so as to bring inner surfaces of the respective adaptor portions into close contact with an outer surface of the stator in connecting the mounting portion and the at least one adaptor to each other.

5. The uniaxial eccentric screw pump according to claim 1, wherein a reinforcing body is integrally provided to the exterior body.

6. The uniaxial eccentric screw pump according to claim 1, wherein the casing covers the stator and the exterior body, and the casing has an inlet for draining vapor or water from a space in which the stator and the exterior body are disposed.

* * * * *